US005080033A

United States Patent [19]

Valiant

[11] Patent Number: 5,080,033

[45] Date of Patent: Jan. 14, 1992

[54] SPINNAKER LAUNCHING AND DOUSING DEVICE

[76] Inventor: Dimitri Valiant, 1729 Bayview Ave., Erie, Pa. 16505

[21] Appl. No.: 566,060

[22] Filed: Aug. 13, 1990

[51] Int. Cl.[5] ..... B63H 9/10

[52] U.S. Cl. ..... 114/104; 114/103

[58] Field of Search ..... 114/102–105; 160/344

[56] References Cited

U.S. PATENT DOCUMENTS

| | | | |
|---|---|---|---|
| 23,440 | 4/1859 | Benson | 114/104 |
| 211,712 | 1/1879 | Dickenson | 114/105 |
| 3,310,018 | 3/1967 | Roberts | 114/104 |
| 4,688,506 | 8/1987 | van Breems | 114/104 |
| 4,831,949 | 5/1989 | Valiant | 114/104 |
| 4,967,680 | 11/1990 | Dailey | 114/104 |

*Primary Examiner*—Joseph F. Peters, Jr.
*Assistant Examiner*—Clifford T. Bartz
*Attorney, Agent, or Firm*—Ralph Hammar

[57] ABSTRACT

A spinnaker of the type collapsed edgewise both laterally and vertically to furl the sail in which the furling line is attached to the top of the sail and the connections of the guy lines to the boat are released to allow the sail to blow freely from the top of the mast as it is collapsed to furl the sail. This isolates the forces of the wind on the sail from the furling line.

3 Claims, 1 Drawing Sheet

SPINNAKER LAUNCHING AND DOUSING DEVICE

This invention is an improvement on the spinnaker of U.S. Pat. No. 4,831,949, incorporated by reference, and which decrease the effort required to furl the spinnaker by 50% or more.

Figure 1:
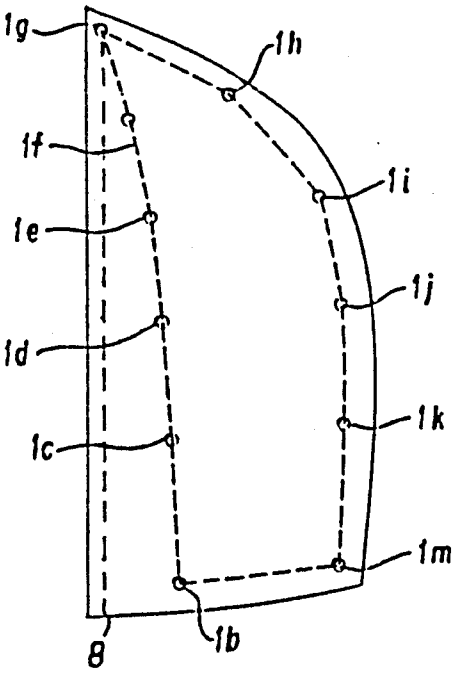

In the drawing, FIG. 1 illustrates the sail of U.S. Pat. No. 4,831,949 with the furling line connected to the upper end of the spinnaker, FIG. 2 is a view showing the spinnaker unfurled and FIG. 3 is a view showing the spinnaker furled.

The spinnaker is a large sail which is useful only for sailing downwind. A change in direction of the boat relative to the wind may require speedy furling of the spinnaker.

Figure 2:
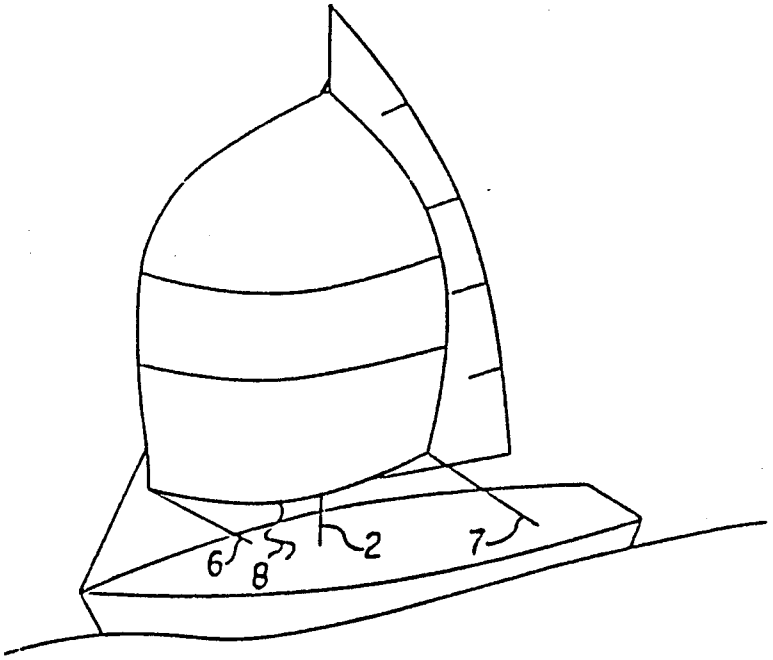
Figure 3:
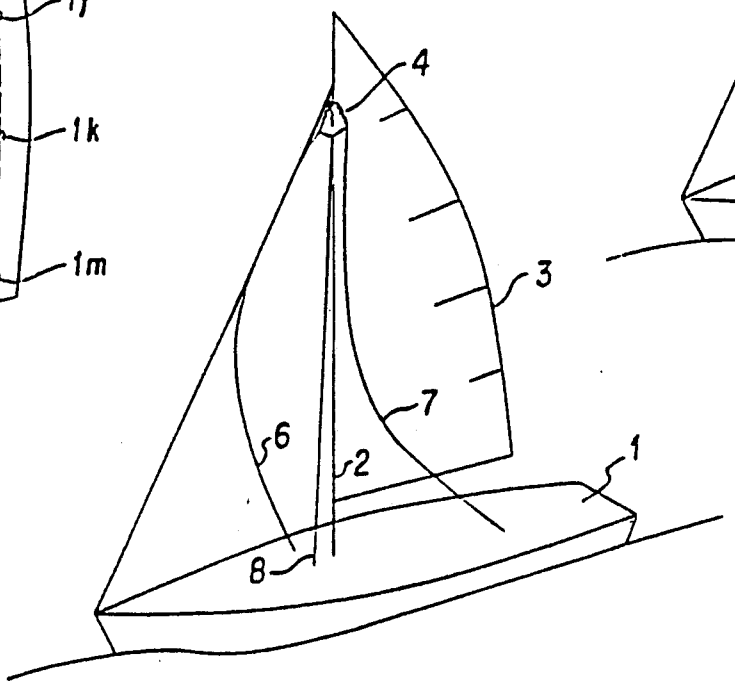

In FIG. 2 the spinnaker 4 is shown unfurled and transmitting the force of the wind to the top of mast 2 and to guy lines 6, 7 fastened to the boat. The spinnaker is ballooned by the wind. In order to cut off the force of the spinnaker when the boat no longer runs downwind, it has been customary to release the connection between the spinnaker and the top of the mast and allow the spinnaker to fall to the boat or sometimes into the water in front of the boat. Releasing the connection from the mast did cut off the force from the spinnaker to the boat but it did cause a great deal of work for the crew in rescuing the spinnaker from the water and folding it so that it could again be used. In this application, when the spinnaker is no longer needed or desired, the lines 6 and 7 are disconnected from the boat and the spinnaker is allowed to blow freely from the top of the mast. In high winds, the spinnaker could be almost horizontal. The furling of the spinnaker is accomplished by a line 8 fixed to eyelet 1*g* at the upper end of the spinnaker and extending from eyelet 1*g* through eyelets 1*h*, 1*i*, 1*j*, 1*k*, 1*m*, 1*b*, 1*c*, 1*d*, 1*e*, 1*f*, 1*g* and then down to the deck of the boat. As the furling line 8 is pulled, the sail is collapsed edgewise both laterally and vertically and in the same manner as U.S. Pat. No. 4,831,949, and when furled is bunched at the top of the mast as shown at 4 in FIG. 3. The edgewise collapsing of the sail is not resisted by the wind. Pivoting of the sail about the top of the mast does not stress the furling line.

As the furling line is tightened, the edgewise contraction of the sail continually decreases the area exposed to the wind. The forces exerted by the wind are not transmitted to the furling line. Accordingly, the furling of the sail of this application is much easier than the furling of the sail in U.S. Pat. No. 4,831,949,

I claim:

1. A spinnaker having guides circumferentially spaced from each other around the periphery of one or more sections of the spinnaker and a furling line extending through said guides for collapsing said one or more sections edgewise both laterally and vertically as said line is tightened to furl said one or more sections, one end of the furling line being fixed to the upper end of the spinnaker and the other end after extending through said guides being accessible for tightening the line to furl said spinnaker.

2. The structure of claim 1 in which the guides are rings on the wind receiving surface of the sail.

3. The structure of claim 1 in which said furling line has one end attached to a first guide on the upper end of said one or more sections and extends from said first guide sequentially through said other guides around the periphery of said one or more sections and back through said first guide for receiving forces for pulling said line through said guides to collapse or furl said one or more sections of the sail.

* * * * *